United States Patent [19]

Gaunt

[11] 4,131,897

[45] Dec. 26, 1978

[54] TV ANTENNA

[76] Inventor: Charles J. Gaunt, 15742 Rushmore, Taylor, Mich. 48180

[21] Appl. No.: 887,432

[22] Filed: Mar. 16, 1978

Related U.S. Application Data

[63] Continuation of Ser. No. 724,329, Sep. 17, 1976, abandoned.

[51] Int. Cl.[2] ..... H01Q 1/30

[52] U.S. Cl. ..... 343/908; 343/896

[58] Field of Search ..... 343/908, 895, 896, 890

[56] References Cited

U.S. PATENT DOCUMENTS

| | | | |
|---|---|---|---|
| 1,670,553 | 5/1928 | Sharp | 343/890 |
| 2,836,824 | 5/1958 | Raymond | 343/896 |
| 3,261,019 | 7/1966 | Lundy | 343/908 |
| 3,952,310 | 4/1976 | Griffee et al. | 343/797 |

*Primary Examiner*—Alfred E. Smith
*Assistant Examiner*—David K. Moore
*Attorney, Agent, or Firm*—Krass & Young

[57] ABSTRACT

The present invention discloses an antenna for broadband radio wave receivers comprising a plurality of conductive elongated members, each being attached at one end to a planar conductive base, the other ends converging at and forming the apex of an enclosed triangular area. Terminals are provided to connect the antenna with a receiver via lead means and jumper means so as to effectively provide a dual band function if required. At least one terminal is electrically and mechanically connected to the conductive base, the connection of the other is dependent upon the specific configuration of the base. The physical size of the antenna is extremely small, a practical size in application will be two to six inches in height.

5 Claims, 5 Drawing Figures

TV ANTENNA

This is a continuation of application Ser. No. 724,329, filed Sept. 17, 1976 and now abandoned.

BACKGROUND OF THE INVENTION

1. Field of the Invention

The invention relates to an antenna for broad-band radio wave receivers such as radios and televisions.

2. Description of the Prior Art

Several patents have been issued for compact broad-band radio wave receiving antennas. These are: Raymond — 2,836,824; Kandoian — 2,640,928; Neil — 1,845,512; Poirier — 1,686,465 and Sharp — 1,670,553. These patents disclose antennas of various configurations, both of the cage and solid types. Patent No. 1,845,512 discloses a configuration that is essentially two pyramids placed base to base, the bases being non-conductive. Patent No. 1,670,553 discloses a pyramid shaped solid antenna with a conductive base which is included primarily for structural support and not for increased reception efficiency.

Antennas of this general shape were developed primarily to replace and improve upon wire antennas which had to be stretched between two spaced supports and properly insulated from the ground. These antennas were generally large and difficult to erect because they required posts, towers or other elevated spaced supports.

Because stretched wire antennas generally had to be outside due to physical size, they were exposed to the elements and subject to corrosion, shorting and wind damage, all of which reduced the efficiency and life of the antennas. The above mentioned patents all addressed these problems and disclosed methods of reducing the mass of broad-band radio wave receiving antenna.

The disclosures of the above mentioned patents were only a partial solution to the size problem. Even though the antennas disclosed did not require sizable structures as did the stretched wire type, they all necessitated an essentially permanent installation which prohibited their use on small portable receiving equipment. The key is to develop a broad-band radio-wave receiving antenna that can be incorporated into or easily accompany small portable receiving equipment such as radios and televisions. It is to this area that the present invention is addressed.

SUMMARY OF THE PRESENT INVENTION

The present invention contemplates an antenna for broad-band radio wave receivers comprising a plurality of conductive elongated members, attached at one end to a conductive base, the other ends of which converge at and form the apex of a triangular enclosed interior area. Terminals are provided to connect the antenna with the intended receiver. One terminal is electrically and mechanically connected to the conductive base and another is alternatively connected to the conductive base, to an insulated ground plane or to an insulated "floating" ground depending upon the specific configuration. Because of the surprising efficiency of the subject antenna, it may be constructed in very small sizes for general household use; a practical size is two to six inches in overall height.

According to specific embodiments of the invention which will subsequently be disclosed in detail, the conductive elongated members are substantially rigid, solid conductive wire of about No. 12 gauge (AWG). The enclosed interior area defined by the conductive elongated members and the means defining a planar conductive base is an equilateral rectangular pyramid, although it is to be understood that the invention contemplates several geometrical variations therefrom.

In the preferred embodiment of the invention, the base means comprises a flat sheet of insulative material having a conductive surface thereon. In an alternative embodiment, a conductive ground plane is added beneath the sheet of insulative material of the preferred embodiment, that is insulated from and substantially parallel to the conductive top surface. In another alternative embodiment, the base means comprises a plurality of coplanar conductive elongated members arranged and electrically and mechanically joined end to end, forming a planar closed figure. In another alternative embodiment, the planar closed figure of the immediately above mentioned embodiment is discontinued in one place along one of the elongated conductive members and terminals are connected to the two points of discontinuation.

It has been found that the subject antenna may serve both VHF and UHF reception by conventional television sets. A convenient arrangement comprises connection of the leads from the antenna terminals diagonally across the UHF and VHF terminals on the set, one antenna lead to UHF and one antenna lead to VHF, and a jumper means connected across the remaining terminals of the set.

Other objectives and advantages of the present invention will be made apparent from the following detailed description of a preferred embodiment and an alternative embodiment of the invention. The invention makes reference to the accompanying drawings.

DETAILED DESCRIPTION OF SPECIFIC EMBODIMENT

Figure 1:
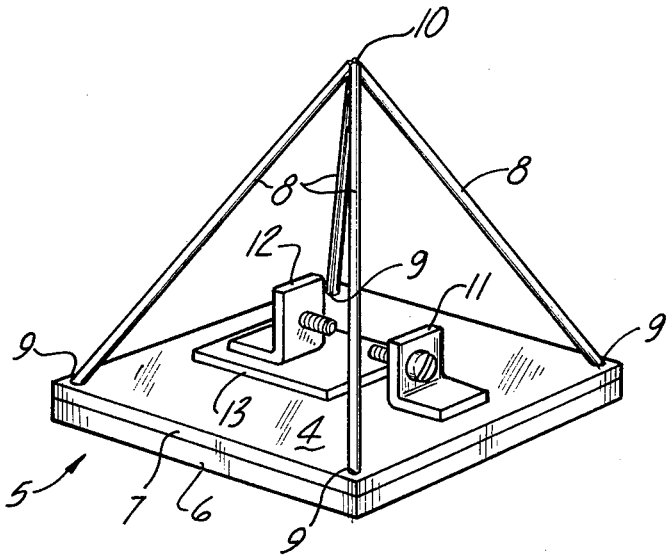
FIG. 1 is a perspective view of the preferred embodiment of the antenna.

Referring to FIG. 1, an antenna 4 for broad-band radio wave receivers constituting a preferred embodiment consists of a rectangular planar conductive base 5 which is made up of an insulative bottom layer 6 and a conductive surface layer 7. One end of each of four separate conductive elongated members 8 is electrically and mechanically connected to the conductive surface layer 7 of the base 5 in each of its four extreme corners 9. The elongated conductive members 8 are of equal length and converge, their free ends forming an apex 10 at which they are electrically and mechanically connected such as by brazing.

A first terminal 11 is electrically and mechanically connected to the conductive surface layer 7 of the base 5. A second terminal 12 is connected to an insulative spacer 13 which in turn is connected to the conductive surface layer 7 of the base 5, effectively creating a "floating" ground in application. Terminals 11 and 12 are positioned on the conductive surface layer 7 of the base 5 so as to allow connection of external lead means (not shown) without interference from the conductive elongated members 8.

Figure 2:
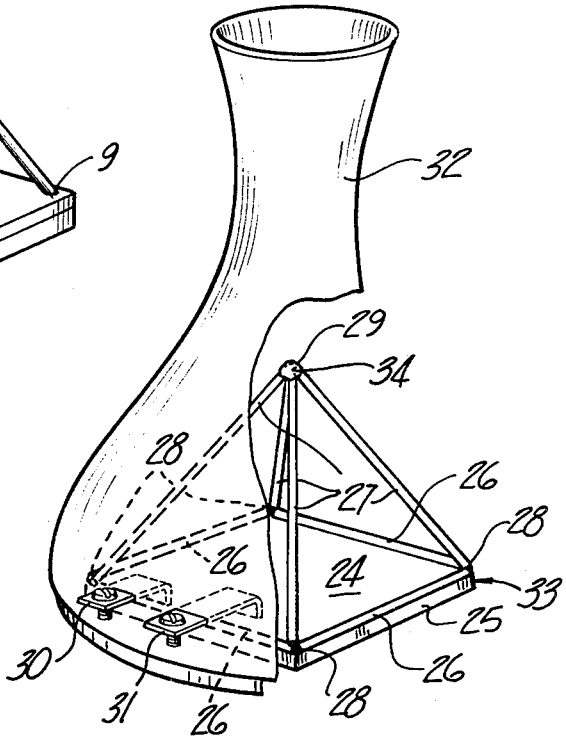
FIG. 2 is a perspective view of an alternative embodiment of the antenna which is molded into a decorative object.

Referring to FIG. 2, an antenna 24 for broad-band radio wave receivers constituting an alternative embodiment comprises a conductive base 33 which consists of a rectangular insulative planar sub-base 25, upon the upper surface of which are affixed four elongated conductive members 26 arranged and electrically and mechanically joined end to end so as to form a closed planar figure which defines and is in substantial alignment with the periphery of the top surface of sub-base 25. One end of each of four separate conductive elongated members 27 is electrically and mechanically connected to one of the four corners 28 of the closed planar figure. The corners 28 are formed in the four places where the ends of two of the elongated members 26 contact one another which correspond with the four extreme corners of the sub-base 25. The elongated conductive members 27 are of equal length and converge, their free ends forming an apex 34 at which they are electrically and mechanically connected such as by brazing 29.

A first terminal 30 is electrically and mechanically connected to one of the four elongated conductive members 26. A second terminal 31 is connected to insulative sub-base 25, creating a "floating" ground in application. Terminals 30 and 31 are positioned so as to allow connection of external lead means (not shown) without interference from the conductive elongated members 26 or 27 nor the insulative decorative object 32 in which the antenna 24 is molded.

Figure 3:
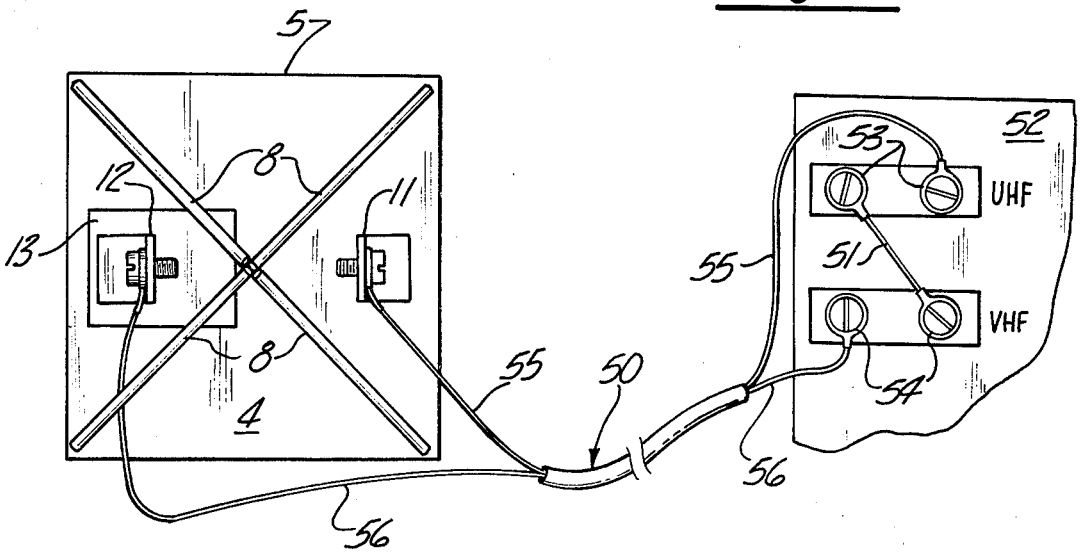
FIG. 3 is a diagram of the electrical connections of the antenna, the lead means and the jumper means to a television having terminals for connection to a UHF antenna and a VHF antenna.

Referring to FIG. 3, the electrical connection of the antenna 4, a lead means 50 and a jumper means 51 to a television 52 having terminals for connection to a UHF antenna 53 and a VHF antenna 54 is diagrammatically illustrated. A conductor 55 of the lead 50 interconnects a terminal 11 of the antenna 4 with one of the UHF terminals 53 of the television 52. A conductor 56 of the lead 50 interconnects the other terminal 12 of the antenna 4 with one of the VHF terminals 54 of the television 52. A jumper 51 interconnects the remaining UHF terminal 53 of the television 52 to the remaining VHF terminal 54 of the television 52.

As illustrated in FIG. 3, the preferred embodiment contemplates a series connection of the antenna 4 to the UHF terminals 53 of the television 52 and the VHF terminals 54 of the television 52. The antenna 4 thus functions as a UHF and VHF antenna simultaneously. The three alternative embodiments herein described are interconnected with the said television by lead 50 and jumper 51 in like manner.

Figure 4:
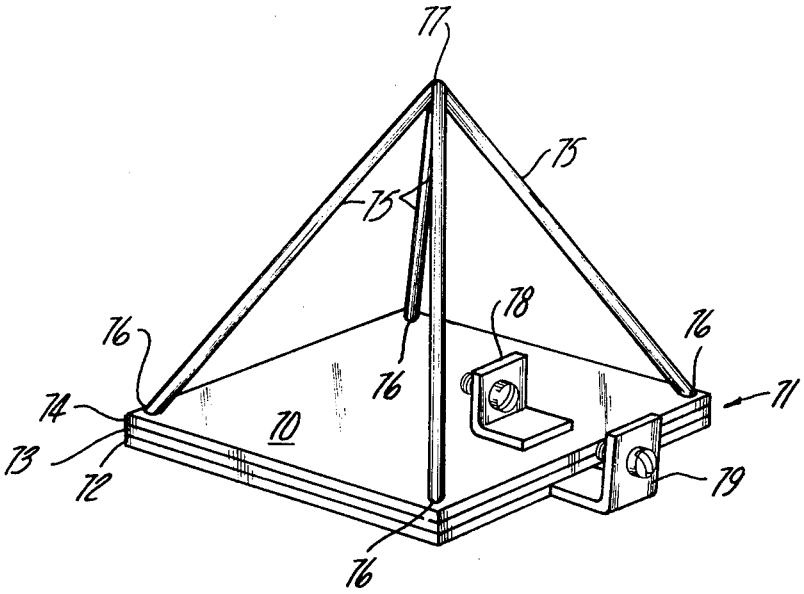
FIG. 4 is a perspective view of another alternative embodiment of the antenna.

Referring to FIG. 4, an antenna 70 for broad-band radio wave receivers, constituting another alternative embodiment comprises a rectangular planar conductive base 71 which is made up of a bottom conductive layer 72, a middle insulative layer 73 and a conductive surface layer 74. One end of each of four separate conductive elongated members 75 is electrically and mechanically connected to the conductive surface layer 74 of the base 71 in each of its four extreme corners 76. The elongated conductive members 75 are of equal length and converge, their free ends forming an apex 77 at which they are electrically and mechanically connected such as by brazing.

A first terminal 78 is electrically and mechanically connected to the conductive surface layer 74 of the base 71. A second terminal 79 is an integral part of the bottom conductive layer 72 of the base 71 which functions as a ground plane and is electrically insulated from the conductive surface layer 74 by the intermediate insulative layer 73 of the base 71. Terminals 78 and 79 are positioned so as to allow connection of external lead means (not shown) without interference from the conductive elongated members 75.

Figure 5:
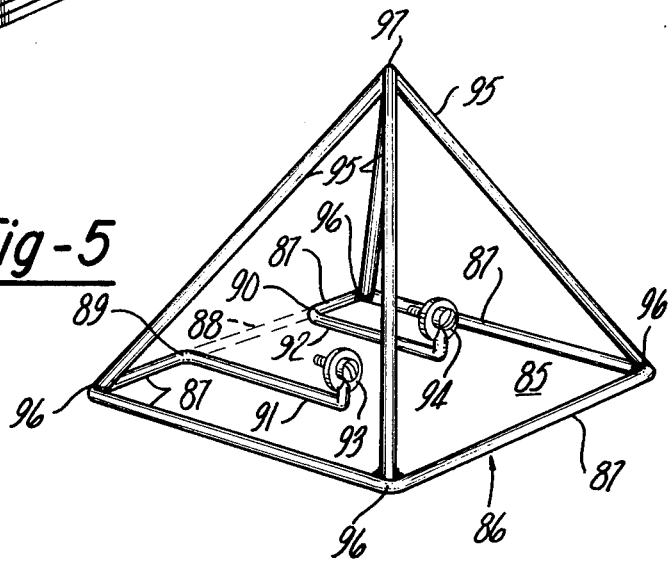
FIG. 5 is a perspective view of another alternative embodiment of the embodiment.

Referring to FIG. 5, an antenna 85 for broad-band radio wave receivers, constituting another alternative embodiment comprises a rectangular planar conductive base 86 which is made up of four elongated conductive members 87 arranged and electrically and mechanically joined end to end so as to form a substantially closed planar figure. One of the four elongated conductive members 87 has a one half inch long discontinuation 88 bisecting it. Associated with the discontinuation 88 are two points of discontinuation 89 and 90, said discontinuation 88 causing the four members 87 to be connected to one another effectively in electrical series. From said two points of discontinuation 89 and 90 emanate two elongated conductive terminal extension parts 91 and 92 respectively, which are substantially parallel to one another and extend inwardly toward the center of said planar base 86. A first terminal 93 is electrically and mechanically connected to the end of extension part 91. A second terminal 94 is electrically and mechanically connected to the end of extension part 92.

One end of each of four separate conductive elongated members 95 is electrically and mechanically connected to one of the four corners 96 of the base 86. The elongated conductive members 95 are of equal length and converge, their free ends forming an apex 97 at which they are electrically and mechanically connected such as by brazing. Terminals 93 and 94 are centrally located on the conductive base 86 so as to allow connection of external lead means (not shown) without interference from the conductive elongated members 87 or 95.

The dual function feature and the extremely small physical size makes the incorporation of the antenna into or inconspicuous interconnection of the antenna with portable broad-band radio receivers feasible. The surprising performance and uniquely pleasing appearance of the antenna may well result in users displaying it "as is". However, the antenna can be molded into decorative objects to disguise its function as an antenna. It is not fully understood why an antenna with this particular geometrical shape performs so well, but its superior performance over the prior art is clear. Although the ideal conductor member diameter and length and base dimensions may vary with application of the antenna to various frequency bands in the radio wave spectrum, the overall shape and appearance will remain the same. Additionally, the terminals of the various alternative embodiments can be relocated, reformed and reshaped as needed when packaging the antenna into a decorative object to allow access to said terminals.

The embodiments of the invention in which an exclusive property or privilege is claimed are defined as follows:

1. An antenna for use in conjunction with and in the immediate proximity of small portable broad band radio wave receivers such as radios and televisions, comprising:

a plurality of conductive elongated members of equal length;

means defining a planar conductive base, said base being composed of an insulative portion and a conductive portion, said insulative portion having a planar surface which is at least in part overlayed by said conductive portion, one end of each of said members being affixed to the conductive portion of said base at spaced points thereon proximate the perimeter thereof to define an enclosed area interior of said members, the other ends of the elongated members converging and being affixed at and forming the apex of an enclosed equilateral rectangular pyramid shaped area;

and first and second terminal means for electrically connecting the antenna to a receiver, said first and second terminal means affixed to said conductive portion and insulative portion respectively of said base.

2. An antenna as defined in claim 1 wherein the elongated members are substantially rigid, solid 12-gauge (AWG) conductive wire.

3. The antenna as defined in claim 1 further comprising a television set having a first set of terminals for connection to a UHF antenna lead and a second set of terminals for connection to a VHF antenna lead, lead means connecting said antenna terminal means to one of the first set of terminals for connection to a VHF antenna lead, and to one of the second set of terminals for connection to a UHF antenna lead, and jumper means for connection of the remaining terminal of the first set of terminals for connection to a VHF antenna lead to the remaining terminal of the second set of terminals for connection to a VHF antenna lead.

4. The antenna as defined in claim 1 further comprising a decorative insulative three-dimensional object into which the antenna is built or molded thereby disguising the function of the antenna, said three dimensions being of substantially the same magnitude.

5. The antenna as defined in claim 1 wherein the conductive portion of said base overlays the entire planar surface of said insulative portion.

* * * * *